United States Patent [19]

Battersby

[11] 4,210,092

[45] Jul. 1, 1980

[54] BOAT ANCHOR

[76] Inventor: Horace V. Battersby, Star Rte. #5 Box 361 H, Dunnellon, Fla. 32630

[21] Appl. No.: 955,654

[22] Filed: Oct. 30, 1978

[51] Int. Cl.[2] ..... B63B 21/46

[52] U.S. Cl. ..... 114/299; 114/304; 114/310

[58] Field of Search ..... 114/294, 295, 297, 299, 114/304–310, 301, 303

[56] References Cited

U.S. PATENT DOCUMENTS

| | | | |
|---|---|---|---|
| 961,095 | 6/1910 | Bateman et al. | 114/308 |
| 2,077,166 | 4/1937 | Clement | 114/308 |
| 3,030,907 | 4/1962 | Rosselle | 114/309 X |
| 3,757,727 | 9/1973 | Hungerford | 114/299 |

*Primary Examiner*—Sherman D. Basinger
*Attorney, Agent, or Firm*—Brady, O'Boyle & Gates

[57] ABSTRACT

A boat anchor having pivoted flukes and a readily detachable loop or pocket shank is provided on opposite sides of each fluke with a pair of free-swinging crown plates whose pivot axes are coaxial with the fluke pivot axis. Fixed stop elements on the crown plates engage the stock of the anchor to limit swinging of the crown plates independently through wide arcs. In any position assumed by the anchor on the bottom and for all positions of the free-swinging crown plates, the flukes will quickly penetrate into the bottom in response to tension on the anchor chain or line transmitted through the shank. If the flukes or crown plates, or both, become fouled on the bottom, the anchor can still be retrieved without difficulty by pulling in the proper direction on the shank due to the free-swinging ability of the crown plates and the flukes relative to the shank. Simplicity of construction, economy of manufacturing, and ease of storage in a small space are important features. No springs are employed in the anchor assembly.

13 Claims, 17 Drawing Figures

FIG 1
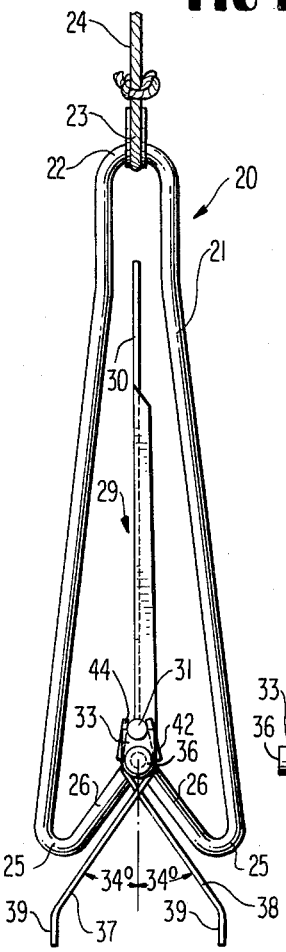
FIG 2
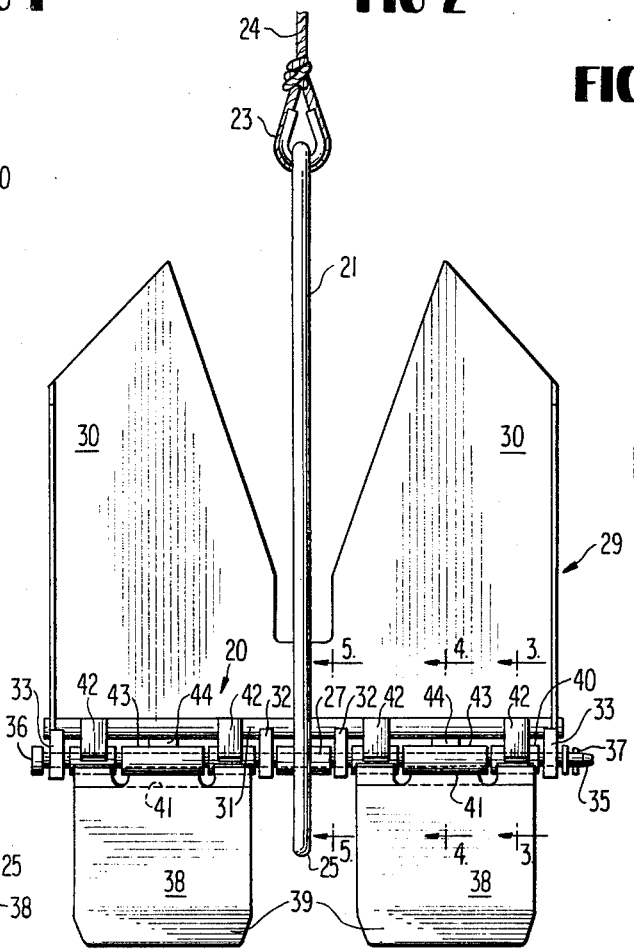
FIG 6
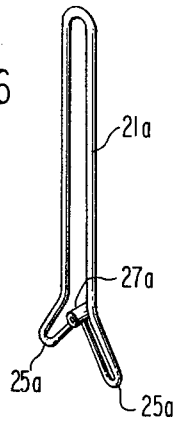
FIG 7
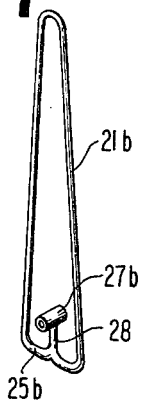
FIG 5
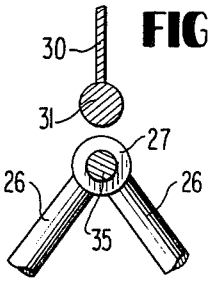
FIG 8
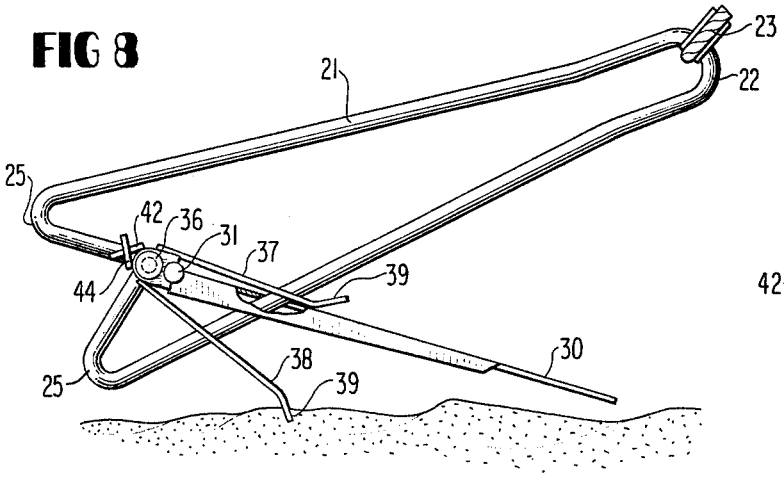
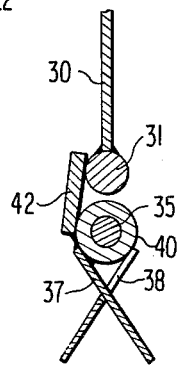
FIG 3
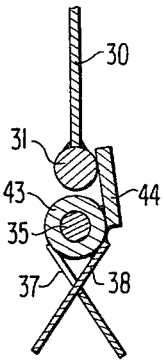
FIG 4

FIG. 9
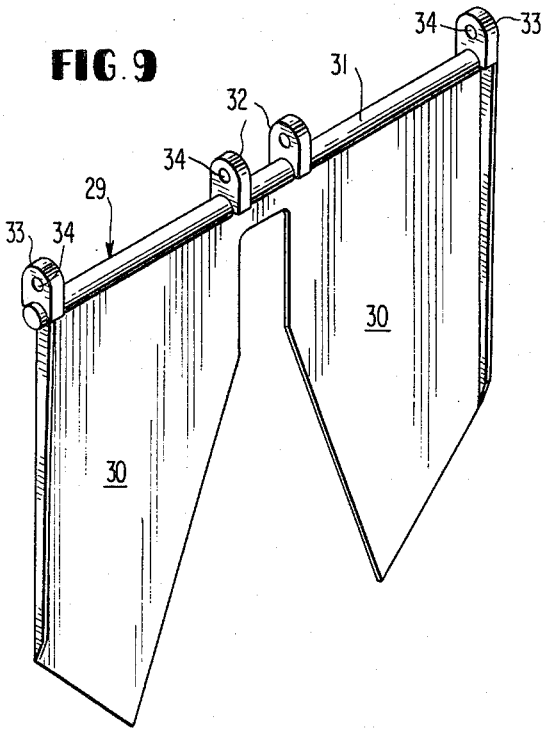
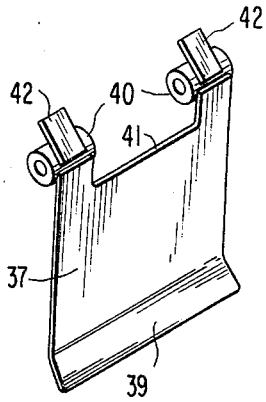
FIG. 10
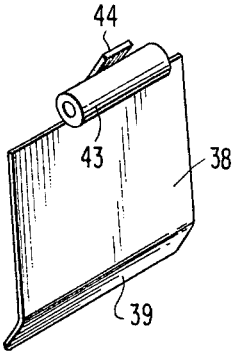
FIG. 11
FIG. 13A
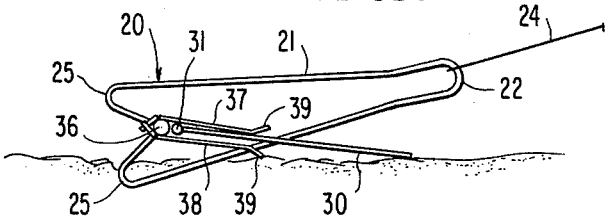
FIG. 12
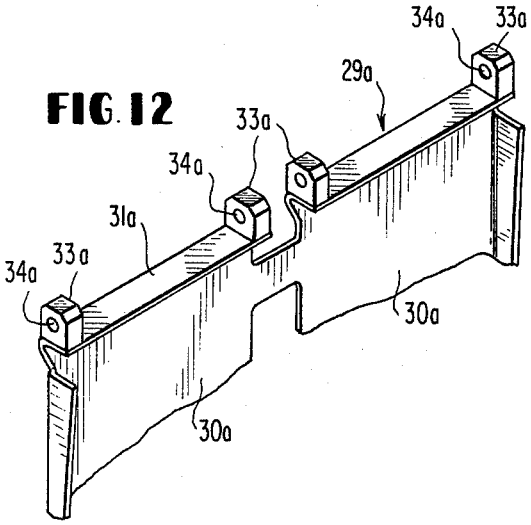
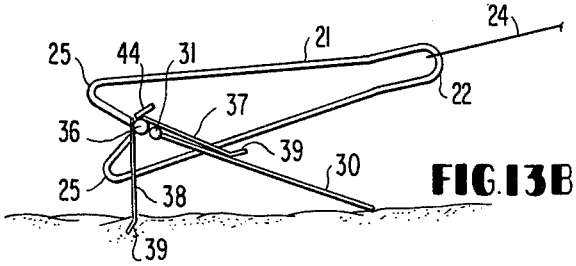
FIG. 13B
FIG. 13C
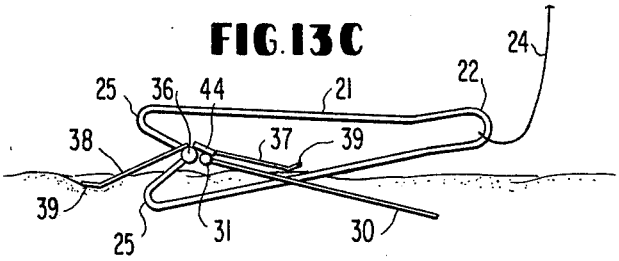
FIG. 14A
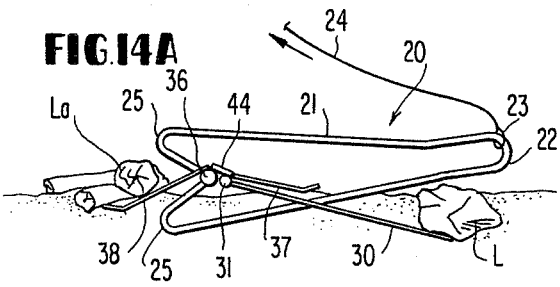
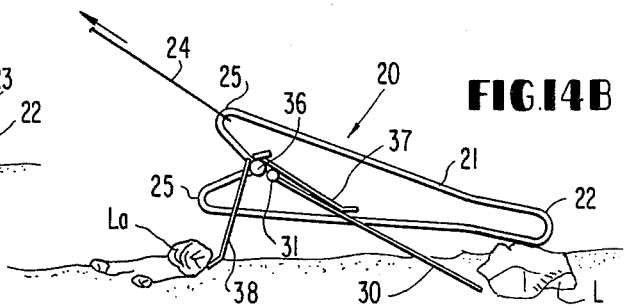
FIG. 14B

BOAT ANCHOR

BACKGROUND OF THE INVENTION

Boat anchors of various types have been known since antiquity and man has constantly sought to improve the efficiency of anchors and to make them more practical. A major advance in the art took place when the Danforth anchor came into being. The Danforth anchor has the flukes pivoted in relation to the shank and may also include crown elements or plates positioned rigidly on the fluke structure. The Danforth anchor, as well as others of the same general type, can be made much lighter than traditional types while still maintaining deep penetrating ability due to the construction and geometry of the anchor. Anchors of the Danforth type have found great utility in connection with smaller boats used for fishing and/or recreation.

A recognized attribute of all pivoted fluke anchors and particularly those possessing crown elements is that the anchors are non-fouling in comparison to rigid traditional types and much more easily retrievable when fouled on the bottom. The development of loop or pocket shanks has increased the retrievability of pivoted fluke anchors still further in the recent prior art.

The below-listed prior U.S. Pat. Nos. are made of record herein under 37 C.F.R. 1.56:

2,249,546
2,487,549
2,490,423
2,563,380
2,641,215
2,894,474
3,024,756
3,026,840
3,030,907
3,269,348
3,430,596
3,557,739
3,964,420

While the devices in these known prior patents include some features common to the present invention and bear a broad similarity to the invention, nevertheless, no known prior art anchor possesses the combined abilities of the invention including greater compactness, easier separation of parts for storage in a smaller space, and, most importantly, a substantial improvement in the ability of the anchor to resist fouling under a variety of situations which may arise when the anchor is on the bottom. This improved anti-fouling ability is derived principally as a result of the provision on opposite sides of the flukes of pairs of independently free-swinging crown plates whose pivot or swing axes are coaxial with the pivot axis of the flukes relative to the shank of the anchor. This arrangement, coupled with an increased swing arc for the crown plates and positive stop means to limit the swinging movement of the crown plates, has added greatly to the overall operational efficiency of the anchor in a manner not heretofore known or attainable in the prior art.

BRIEF DESCRIPTION OF THE DRAWINGS

FIG. 1 is a side elevation of an anchor according to the present invention in a free-hanging condition, illustrating the limits of free-swinging movement of pairs of crown plates included on the anchor, and showing the flukes in alignment with the center axis of the shank for greater clarity in illustration, rather than showing them in the normal position pivoted approximately 34°-36° from the center position shown, as in FIG. 8.

FIG. 2 is an elevational view of the anchor taken at right angles to FIG. 1.

FIGS. 3, 4 and 5 are enlarged fragmentary vertical sections taken, respectively, on lines 3—3, 4—4, and 5—5 of FIG. 2.

FIGS. 6 and 7 are perspective views showing alternate types of shanks usable on the anchor.

FIG. 8 is a side elevation showing the anchor in a random rest position on the bottom.

FIG. 9 is a perspective view of the anchor flukes and stock.

FIG. 10 is a perspective view of a first crown plate including its bearings and fixed stop elements.

FIG. 11 is a perspective view of a second crown plate, bearing and stop element.

FIG. 12 is a fragmentary perspective view showing a modified form of fluke with integral stock flange and bearings.

FIGS. 13A to 13C are diagrammatic elevational views of the anchor on the bottom and illustrating its bottom penetrating ability resulting from coaction of the flukes with the free-swinging crown plates.

FIGS. 14A and 14B are similar views of the anchor fouled on the bottom and depicting the ability of the anchor to be released and retrieved.

DETAILED DESCRIPTION

Referring to the drawings in detail wherein like numerals designate like parts, a boat anchor designated generally by the numeral 20 comprises a shank 21 of the closed loop type, also known as a pocket shank. The shank 21 has converging side members, FIG. 1, terminating in a bight portion 22 adapted to receive loosely an eye element 23 on the anchor line or chain 24. At its end away from the bight portion 22, the shank 21 has two generally V-shaped pockets 25, or extensions, which are capable of receiving the eye element 23 at proper times, the eye element being freely slidable along the opposite sides of the pocket shank. The interior side members 26 forming the pockets 25 are rigidly connected at their tops to a bearing sleeve 27, FIG. 2, whose axis is disposed at right angles to the plane of the pocket shank 21, the bearing sleeve projecting beyond the opposite sides of the shank. It will be seen that the axis of the bearing sleeve 27 defines the pivot or articulation axis of the anchor between its shank and flukes and associated parts, yet to be described, and it should be noted that the shank pockets 25 are located well below the articulation axis defined by the bearing sleeve 27 and on opposite sides thereof equidistantly.

In lieu of the shank 21 shown in FIGS. 1 and 2, alternate forms of shanks 21*a* and 21*b* shown in FIGS. 6 and 7 may also be utilized successfully. The shank 21*a* has parallel arms or sides, a pair of symmetrically arranged pockets 25*a*, and a bearing sleeve 27*a* at the same relative location as the bearing sleeve 27. The shank 21*b* has convergent sides and lower end pockets 25*b* separated by a central short stem 28 carrying the bearing sleeve 27*b* of the shank 21*b*.

The anchor 20 additionally comprises a fluke subassembly 29 shown in detail in FIG. 9 and including divided pointed flukes 30 having a stock 31 formed of sturdy rod stock welded to their upper edges. Inboard and outboard aligned fluke bearings 32 and 33 are fixed by welding or the like to the stock 31, as illustrated. The aligned bores 34 of the bearings 33 receive therethrough an elongated anchor articulation pin 35 having a head 36 at one end thereof and a readily removable cotter pin 37 or equivalent means at its opposite end whereby the pin 35 is easily removable to allow separation of the shank 21 from the fluke structure. This renders the anchor easy to store in a small space under floorboards of a boat, against bulkheads or even on the deck of a boat in an out of the way flat and compact state. The articulation pin 35 is also received through the shank bearing sleeve 27, as shown clearly in FIG. 2.

A key feature of the invention is the provision on opposite sides of each fluke 30 of an opposing pair of free-swinging crown plates 37 and 38, each crown plate being generally rectangular and of equal size in relation to the opposing crown plate of the pair. The lengths and widths of the crown plates 37 and 38 in relation to the size of the flukes 30 are approximately as illustrated in the drawings, that is, having widths extending across the major portion of the width of the flukes and having lengths such that the free-swinging ends terminate at points on the flukes somewhat less than one-half the length of the flukes, although their dimensions may be varied slightly. Each crown plate 37 and 38 has a transverse angled lip 39 at its free-swinging end away from the articulation axis of the anchor. In the assembled anchor, the lips 39 of the crown plates when folded against opposite sides of the flukes 30 project outwardly from the flukes at acute angles thereto, FIGS. 8 and 13A. Each crown plate 37 has a pair of coaxial bearing sleeves 40 welded to its end remote from the lip 39 on opposite sides of a cut-out 41. A pair of rigid stop elements, such as chunks of weld or plates 42, are welded to the bearing sleeves 40 and project at an obtuse angle to the plane of the crown plate 37, FIG. 3. Each crown plate 38 has a single bearing sleeve 43 welded centrally to the edge thereof away from the lip 39 and a single center rigid stop element 44 is welded to the bearing sleeve 43 and forms an obtuse angle with the plane of crown plate 38, which angle is equal to the angle between the elements 37 and 42, FIGS. 3 and 4.

In assembled folded relationship, the crown plates 37 and 38 of each free-swinging pair lie on opposite sides of one fluke 30 and the aligned bores of the bearing sleeves 40 & 43 receive therethrough the long articulation pin 35. Thus, the crown plates 37 and 38 have their swing axes coaxial with the pivot or articulation axis of the anchor flukes relative to the pocket shank 21. Referring to FIG. 2, it may be seen that the several bearing sleeves 40 and 43 interfit axially with each other and with the fluke bearings 32 and 33 along the continuous and readily removable articulation pin 35.

In connection with the free-swinging operation of the crown plates 37 and 38, each crown plate can swing through an arc of approximately 146 degrees from a first position lying against one side of a fluke 30 in generally parallel relation thereto, FIG. 8, to a second or fully extended position shown in FIG. 1. The crown plates of each pair swing in a common plane substantially at right angles to the plane of the fluke unit. The advantages of this arrangement will be further described. When the crown plates 37 and 38 are in their fully extended positions shown in FIG. 1 and also shown approximately in FIG. 13c for one of the crown plates, their respective rigid stops 42 and 44 will abut one side of the stock 31 to positively arrest swinging movement of the crown plates in one direction. Swinging movement in the opposite direction is limited by contact with the flukes 30.

In lieu of the fluke sub-assembly 29 shown in FIG. 9, a modified fluke sub-assembly 29a, FIG. 12, may be utilized. In this modified arrangement, the rod forming stock 31 is eliminated and in lieu thereof a short right angular stock flange 31a is formed at the corresponding location on the fluke subassembly. Fluke pivot bearings 33a having aligned bores 34a are secured to the flange 31a in the same relative locations as the bearings 33 in FIG. 9 and functioning in the same manner. In other respects, the fluke sub-assembly 29a is like the previously-described sub-assembly 29. In the use of the modified sub-assembly 29a, the crown plate stops 42 and 44 engage the flange 31a instead of the stock 31, as described, but the result is the same in terms of defining the limits of swing for the crown plates.

In the use or operation of the improved anchor, with particular reference to drawing FIGS. 13a and 14b, it should be realized that the anchor can land in virtually any position on the bottom and in so doing the free-swinging crown plates 37 and 38 are not controlled and can assume any position relative to the flukes 30 and shank 21 when the anchor lands on the bottom. In this regard, FIG. 13a depicts what is probably the most difficult or non-advantageous position of the anchor 20 on the bottom and if the anchor will act satisfactorily and penetrate the bottom quickly without tumbling, planing or sliding appreciably after landing in the position of FIG. 13a it will function satisfactorily in virtually any position in which it might land on the bottom, other than the illustrated position.

In FIG. 13a, the flukes 30 are almost parallel to the bottom and are at an extremely acute angle to the long axis of the shank 21. There is no penetration of the flukes 30 in the bottom and no penetration of the underlying crown plates 38 which are substantially parallel to the flukes and near their fully closed position against the flukes. The distant crown plates 37 or upper crown plates, FIG. 13a, are likewise closed and parallel to the flukes 30 and crown plates 38.

Notwithstanding this rather adverse landing arrangement in FIG. 13a, and referring to FIG. 13b, when the line or chain 24 is tensioned longitudinally of the pocket shank 21, the lips 39 of free-swinging crown plates 38 will begin to scrape the bottom and penetrate and will swing quickly to a near vertical position, acting as a leg to elevate the shank 21 from the bottom and increase the angle of the flukes 30 so that they can begin to penetrate the bottom.

Moving to FIG. 13c, further pulling on the line 24 has achieved substantial penetration of the flukes 30 into the bottom and the crown plates 38 have continued to swing and have reached the full approximate 146 degree limit of their travel established by engagement of their stop elements 44 with the stock 31, as shown in FIG. 13c. It will be understood that had the anchor landed on the bottom with the crown plates 37 arranged lowermost and the crown plates 38 uppermost, an identical mode of operation to that described immediately above would have taken place with the same results in terms of efficient penetration, minimal sliding or skating on the bottom or other undesirable movement prior to penetration. In fact, with the arrangement of the paired free-swinging lipped crown plates in their relationship to the flukes and the articulated shank, regardless of the position of landing on the bottom the anchor will quickly and positively lock itself to the bottom in the manner described.

FIGS. 14*a* and 14*b* illustrate the ready retrievability of the improved anchor 20 even under the most drastic conditions of fouling which might be encountered. In FIG. 14*a*, the anchor is on the bottom with the flukes 30 substantially embedded in the bottom sand and also lodged beneath a heavy log L or other obstruction. At the same time, a second log La has come to rest on the extended crown plates 38 whose positive stops 44 are against the stock 31 rigidly. Notwithstanding this double fouling of the anchor, while in a most disadvantageous position, the eye or slide ring 23 of the line or chain 24 can be slid from the bight 22 to the uppermost pocket 25 of shank 21 with tension applied to the line 24, as indicated in FIG. 14*b*. Under such tension in the direction shown, the anchor will have a resultant direction of movement whereby the flukes 30 will be extracted from beneath the log L and simultaneously the crown plates 38 will be extracted from under the log La with a combined sliding and swinging movement counterclockwise around the axis of the articulation pin 35. In other and less drastic situations of fouling, the ever-present coaction of the free-swinging crown plates 37 and 38 with the articulated loop shank 21 and flukes 30 allows ready retrieval of the anchor and avoidance of its loss which is obviously costly to the boatman in any situation.

While the drawings show a pair of free-swinging crown plates on each side of the fluke unit, it is to be understood that the invention encompasses only a single pair of free-swinging crown plates, with one crown plate of the pair on each side of the fluke unit and hinged to the anchor, in generally the same manner as previously described. When only a pair of crown plates are utilized in the anchor structure, they may have a greater width relative to the width of the flukes than the crown plates illustrated in the drawings to provide stability, depending on the dimensions of the anchor elements, but they function in the same manner as the free-swinging crown plates described herein.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An anchor comprising a fluke unit defining a plane, a pocket shank, means forming an articulation joint between said fluke unit and pocket shank and defining an axis, a pair of crown plates positioned one on each side of the fluke unit and hingedly connected in free-swinging relation to each other and to said fluke unit on the axis of the means forming the articulation joint of the anchor, said crown plates swinging in a common plane substantially at right angles to the plane of the fluke unit and a stop element on each free-swinging crown plate engageable with the fluke unit to limit the swinging path of movement of the respective crown plate between a first position at one side of the fluke unit and a second position away from the fluke unit, said second position of each crown plate being defined by an included angle between the fluke unit and crown plate substantially greater than ninety degrees.

2. An anchor as defined in claim 1, and said included angle being approximately 146 degrees.

3. An anchor as defined in claim 1, and each crown plate having an angled lip on its free-swinging end away from the axis of the articulation joint, and said lips projecting outwardly from opposite faces of the fluke unit when the anchor is in folded position with said crown plates arranged on opposite sides of the fluke unit.

4. An anchor as defined in claim 1, and said fluke unit including a stock and a pair of separated flukes rigid with the stock and lying in a common plane and extending from one side of the stock, and a pair of said free-swinging crown plates for each fluke with one crown plate in each pair on each side of the fluke and extending across the major portion of the width of the fluke and having its free-swinging end terminating at a point on the fluke somewhat less than one-half the length of the fluke in the direction away from the axis of the articulation joint, and said stop element on each crown plate engaging said stock to limit said swinging path of movement of the crown plate.

5. An anchor as defined in claim 1, and said pocket shank having two laterally spaced pockets on opposite sides of the axis of said articulation joint and spaced from said axis in a second direction transverse thereto and longitudinally of the fluke unit, and a sleeve bearing on the pocket shank coaxial with said means forming said articulation joint and rotably engaged with said means.

6. An anchor as defined in claim 5, and said fluke unit including a stock and bearings secured to the stock and being engaged rotationally with said means forming said articulation joint.

7. An anchor as defined in claim 6, and said stock consisting of a rod extending transversely across the fluke unit and fixed to corresponding ends of the flukes of said unit.

8. An anchor as defined in claim 6, and said stock consisting of an integral flange on one end of the fluke unit substantially at right angles to a plane in which the flukes of the unit lie.

9. An anchor comprising a fluke unit, a pocket shank, means forming an articulation joint between said fluke unit and pocket shank, bearings secured to said fluke unit and being engaged rotationally with said means forming said articulation joint, said pocket shank having two laterally spaced pockets on opposite sides of the axis of said means forming the articulation joint and spaced from said axis in a second direction transverse thereto and longitudinally of the fluke unit, a sleeve bearing on the pocket shank coaxial with and rotatably engaged with said means forming said articulation joint, a pair of free-swing crown plates one on each side of the fluke unit and having bearings secured to corresponding ends thereof and being engaged rotationally with said means, the bearings of the fluke unit and crown plates being coaxial with the axis of the articulation joint and interfitting along said axis, and a stop element on each free-swinging crown plate engageable with the fluke unit to limit the swinging path of movement of the crown plate between a first position at one side of the fluke unit and a second position away from the fluke unit, said second position of the crown plate being defined by an included angle between the fluke unit and crown plate substantially greater than ninety degrees.

10. An anchor as defined in claim 9, and said means forming said articulation joint being a single elongated pin extending through the bores of all of said bearings.

11. An anchor as defined in claim 9, and said stop elements on said crown plates comprising rigid plate elements fixed to the bearings of the crown plates and disposed at obtuse angles to planes in which the bodies of the crown plates lie.

12. An anchor as set forth in claim 9, and said fluke unit including a stock and said fluke unit bearings secured to said stock.

13. An anchor as defined in claim 12, and said stock of the fluke unit being spaced laterally of and parallel to the axis of said means forming said articulation joint.

* * * * *